United States Patent [19]

Hall

[11] 4,090,424

[45] May 23, 1978

[54] APPARATUS FOR CUTTING FILTER PLUGS FROM A MOVING FILTER ROD STREAM

[75] Inventor: Floyd Vanmeda Hall, Durham, N.C.

[73] Assignee: Liggett Group Inc., Durham, N.C.

[21] Appl. No.: 782,399

[22] Filed: Mar. 29, 1977

[51] Int. Cl.[2] ..... B26D 1/26; B26D 7/12

[52] U.S. Cl. ..... 83/330; 83/926 C; 93/77 FT

[58] Field of Search ..... 93/77 FT, 1 C; 83/329, 83/330, 926 C, 913; 131/264–266

[56] References Cited

U.S. PATENT DOCUMENTS

| | | | |
|---|---|---|---|
| 1,846,942 | 2/1932 | Bronander et al. | 83/329 |
| 1,888,774 | 11/1932 | Rundell | 83/329 |
| 1,893,057 | 1/1933 | Hohn | 83/329 X |
| 3,357,321 | 12/1967 | Hall | 93/1 C |
| 3,464,421 | 9/1969 | Pinkham et al. | 93/1 C X |

*Primary Examiner*—James F. Coan

*Attorney, Agent, or Firm*—J. Bowen Ross, Jr.; Michael L. Hendershot

[57] ABSTRACT

The apparatus employs two pairs of cutting discs which are diametrically spaced apart on a rotating drum to sever two filter plugs at a time from a travelling rod of filter material. The plugs are cut in uniform size, for example, in sizes between 5 millimeters and 14 millimeters and can be subsequently spaced apart so as to receive charcoal or other particulate filter material in the intermediate spaces. The drum rotates in synchronism with a recessed ledger through which the respective pairs of cutting discs pass to sever the travelling rod of filter material. Sharpening means are provided to maintain the cutting discs sharp.

1 Claim, 9 Drawing Figures

10
11
12
13
14
15
16
17
18
19
20
21
22
23
24
25
26
27
28
29
30
46
47
48
49
50

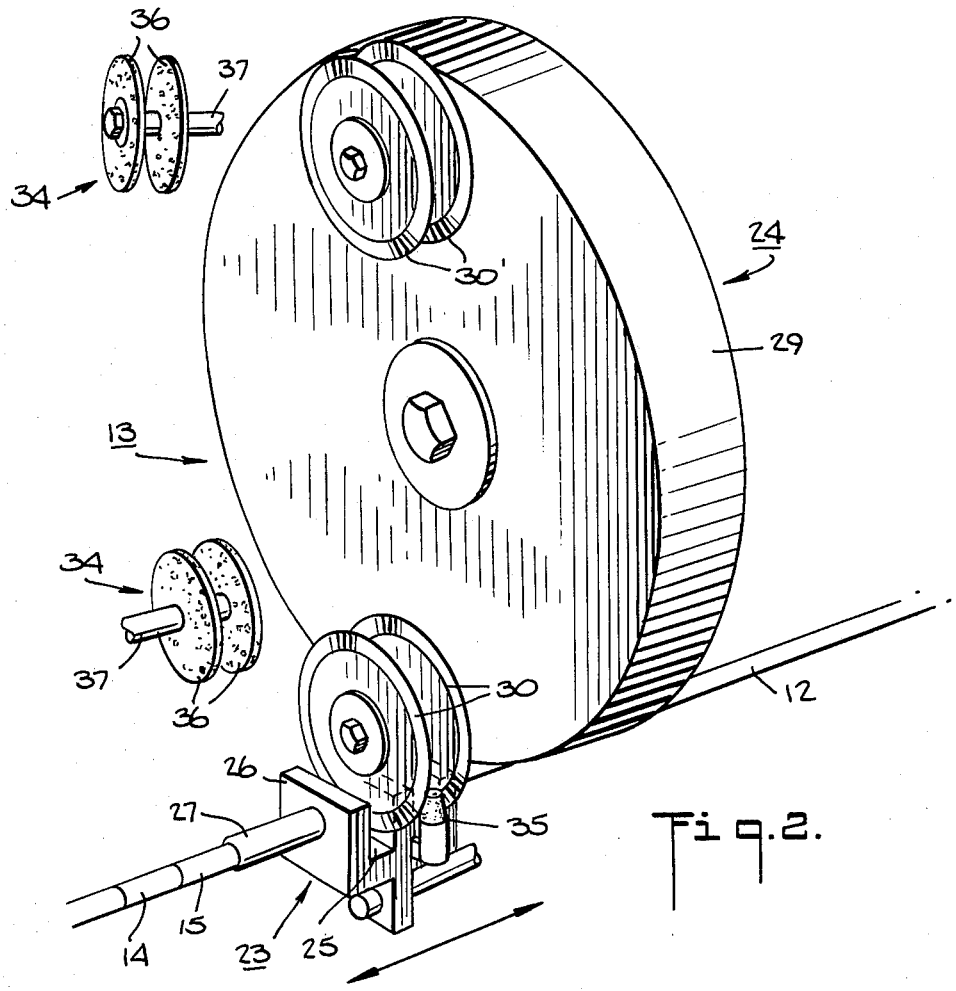
Fig. 2.
Fig. 6.
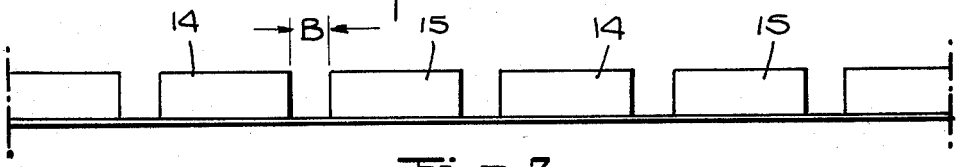
Fig. 7.
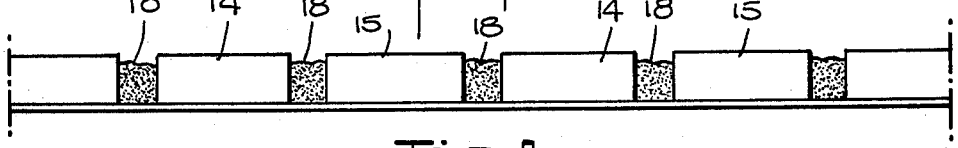
Fig. 8.
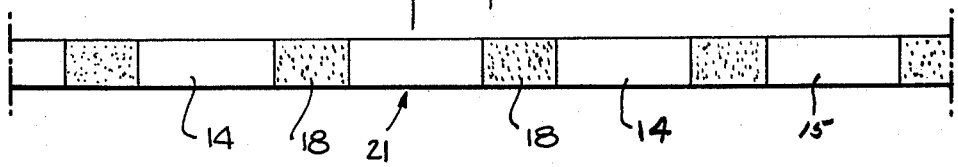

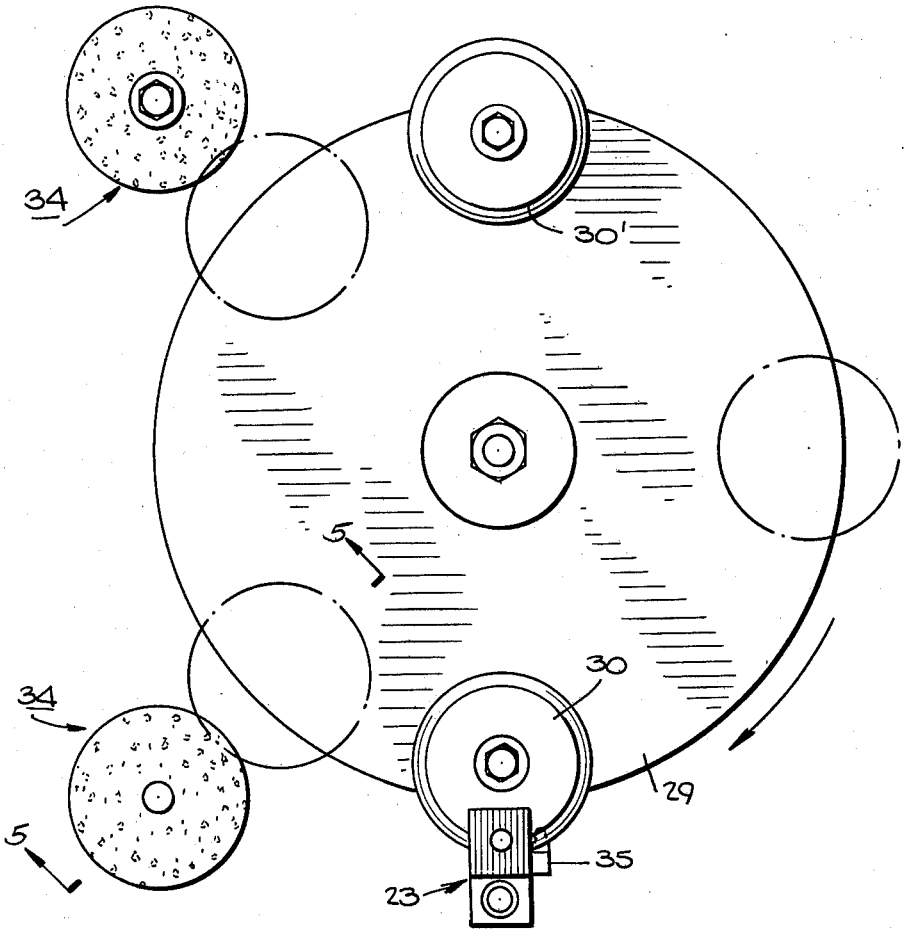
Fig. 4.
Fig. 5.
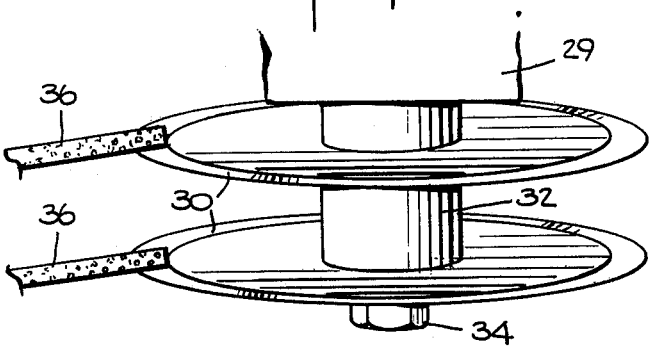

APPARATUS FOR CUTTING FILTER PLUGS FROM A MOVING FILTER ROD STREAM

This invention relates to an apparatus for cutting filter plugs from a moving filter rod stream. More particularly, this invention relates to a knife assembly for severing a moving rod of filter material into pairs of filter plugs.

Heretofore, it has been known to cut a travelling rod made, for example of a fibrous filter material such as cellulose acetate, into a series of short lengths to form individual filter plugs. In some cases, the rod has been passed through a cutter formed of a ledger and a rotating knife. Usually, the ledger is formed with a recess and guide tubes which extend part way into the recess to guide the rod while the knife is mounted to pass through the recess between the guide tubes to sever the rod into plugs. In addition, the ledger is reciprocated so as to move with the moving rod during a cut in order to preclude bunching up of the rod behind the knife. In one known construction, the knife is in the form of a rotatable drum on which a pair of cutting discs are mounted in diametrically disposed relation in order to cut two plugs for each revolution of the drum. However, the overall output of such a cutter has usually been limited, for example, to about 3,000 plugs per minute. This is due, in part, to the fact that the speed of the reciprocating ledger is limited. That is, the ledger cannot be speeded up to any great speed without creating problems such as excessive vibration, wear, timing, braking and the like.

Accordingly, it is an object of the invention to increase the output of a cutter for cutting filter plugs from a moving rod.

It is another object of the invention to provide a simple modification for an existing rod cutter in order to substantially increase the output of the cutter.

Briefly, the invention provides an apparatus for making filter rods for cigarettes which employs a knife assembly for severing a moving rod of filter material into successive plugs on a high speed basis. The apparatus includes a means for delivering a continuous rod of entrainment-type filter material in a predetermined path in which the knife assembly is disposed, a means for wrapping a strip of paper around the severed plugs to form a continuous filter rod and a knife for severing the formed rod into predetermined lengths.

The knife assembly includes a ledger having a plurality of recesses which are laterally spaced apart and guide tubes which extend across the recesses in coaxial alignment to guide the moving rod of the filter material through the recesses. These guide tubes are spaced apart within each recess in order to expose a portion of the rod for severing. In addition, the knife assembly includes a knife having two sets of cutting discs mounted for sequential passage through the recesses of the ledger. These cutting discs are mounted on a rotatable drum in diametrically opposed positions and are spaced apart so as to simultaneously pass through the respective recesses in the ledger during rotation of the drum.

During use, a rod of filter material is passed into the ledger through the guide tubes while being exposed within each recess of the ledger. At the same time, the drum is rotated so that a first set of cutting discs (e.g. a set of two discs) passes through the recesses of the ledger to sever a multiplicity (e.g. two) plugs from the moving rod. Continued delivery of the rod pushes the cut plugs forwardly out of the ledger. At the same time, the second set of cutting discs (e.g. a set of two) pass into the recesses of the ledger and severs the rod to produce another group of plugs. This operation continues so as to cut groups of plugs for each pass of the cutting discs through the ledger.

The speed of the rod through the ledger and the speed of the drum on which the cutting discs are mounted as well as the position of the cutting discs on the drum are synchronized so as to effect a successive severing of the plugs of equal length from the moving rod. Should a need arise to change these plug lengths, the speed of the delivered rod can be varied.

In order to permit the cutting discs to form an even cut without bunching of the filter rod by the discs, the discs are disposed at a slight angle relative to their axes of rotation on the drum and the ledger is moved forwardly during a severing operation in which the discs pass through the ledger. After severing is complete, the ledger is moved rearwardly in order to move into proper position for the next cut. This reciprocation of the ledger is also synchronized with respect to the speed of the moving rod and the rotational speed of the drum of the knife.

The apparatus may also include a means for spacing the severed plugs from each other as well as a means for sequentially depositing absorptive-type filter material between the plugs prior to formation of the continuous filter rod.

By way of example, if the filter rod is moving at a rate of 6,000 plugs per minute, the ledger also moves fowardly at the same speed. Where each set of cutting discs is made up of two discs, the rotatable drum of the knife assembly rotates at a speed of 1500 revolutions per minute. Thus, for each revolution of the drum, four plugs are cut from the moving rod. If the cutting discs are spaced apart a distance from centerline-to-centerline of 9 millimeters, then the size of the plugs will also be 9 millimeters. In order to change the size of the cut plug, the spacing of the cutting discs is changed, for example within the range of from 5 to 14 millimeters. The speed of the moving rod is also changed. For example, if the plugs are to be 14 millimeters in length, then the speed of the rod for 6,000 plugs per minute is 8.4 meters per minute. Conversely, if the plugs are to be 5 millimeters in length, the speed of the moving rod becomes 3.0 meters per minute.

The apparatus may also include various sharpening means for maintaining the cutting discs in a sharpened condition. To this end, pairs of whetting discs are mounted astride the drum in the path of the pairs of cutting blades so as to whet the edges of the disc. In addition, a whetting stone may be mounted at a point near the entrance to the recesses of the ledger for sharpening the cutting discs immediately prior to severing.

These and other objects and advantages of the invention will become more apparent from the following detailed description and appended claims taken in conjunction with the accompanying drawings in which:

FIG. 2 illustrates a knife assembly in accordance with the invention;

FIG. 3 illustrates a side view of the knife assembly in accordance with the invention;

FIG. 4 illustrates a schematic view of a sharpening means for the knife assembly according to the invention;

FIG. 5 illustrates a view taken on line V—V of FIG. 4;

FIG. 6 illustrates a view of a series of spaced apart severed plugs on the apparatus according to the invention;

FIG. 7 illustrates a view of a series of severed plugs with absorptive-type material placed in the spaces therebetween;

Figure 1:
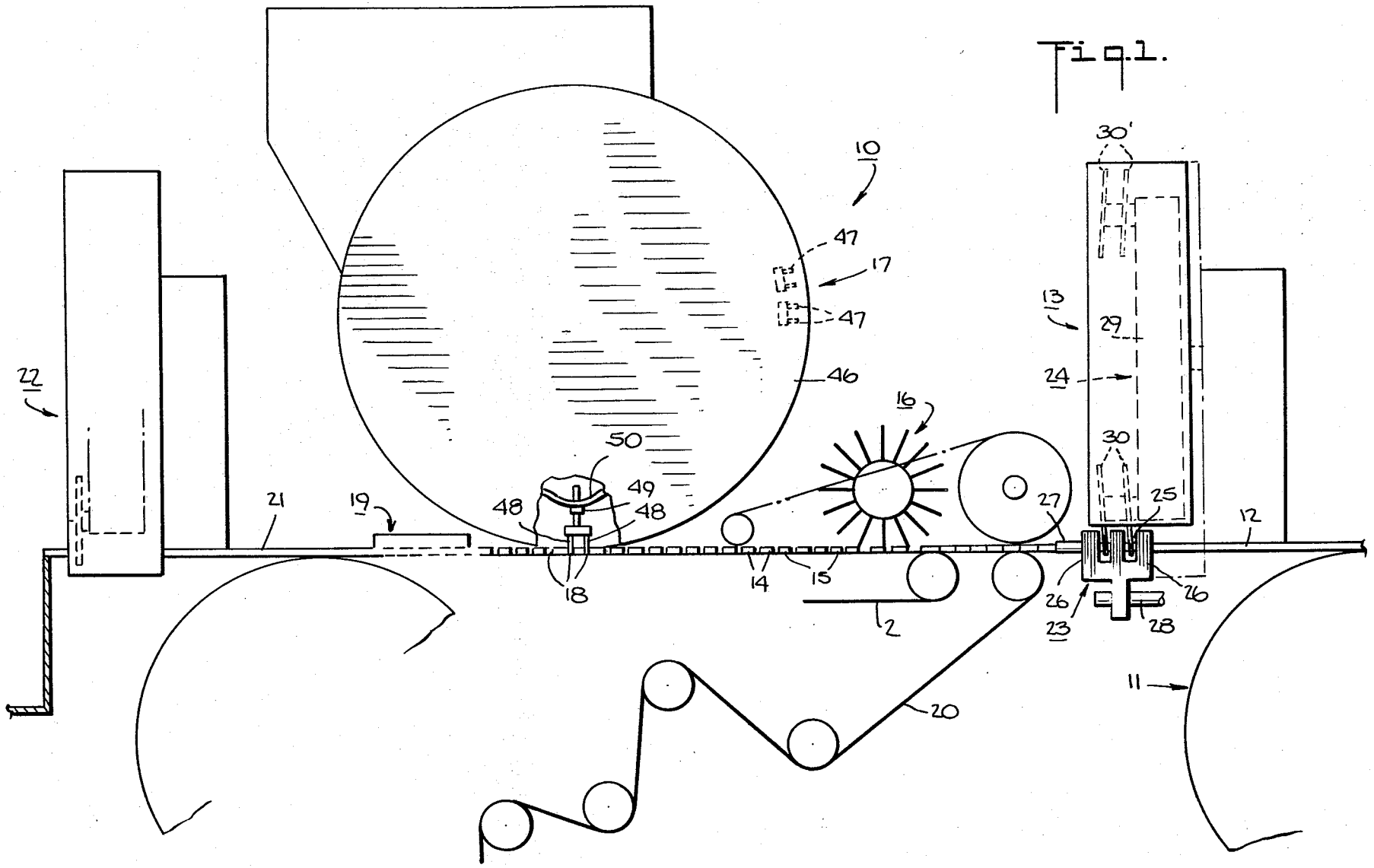
FIG. 1 illustrates a schematic view of an apparatus in accordance with the invention.

Referring to FIG. 1, the apparatus 10 includes a means 11 for delivering a continuous rod 12 of entrainment type filter material, such as cellulose acetate in a predetermined path, a knife assembly 13 in the path of the rod 12 for severing discrete plugs 14, 15 from the rod 12, a means 16 for spacing the plugs 14, 15 from each other, a means 17 for sequentially depositing absorptive-type filter material 18 between the plugs 14, 15, a means 19 for wrapping a strip of paper 20 around the plugs 14, 15 and filter material 18 to form a continuous filter rod 21 and a knife 22 for severing the rod 21 into predetermined lengths.

The means 11 for delivering the rod 12 of filter material is of conventional structure and generally employs a conveyor of endless belt type to carry along and deliver the rod 12.

Referring to FIGS. 1, 2 and 3, the knife assembly 13 includes a ledger 23 and a knife 24. The ledger 23 is of generally block shape construction and is formed with a plurality, i.e., two recesses 25 between three walls 26. Each of these walls 26 has a guide tube 27 mounted therein in coaxial alignment with the other tubes 26. The ledger 23 is interposed in the path of the rod 12 to guide the rod 12 through the guide tubes 27 and through the respective recesses 25. In addition, the ledger 23 is fixedly mounted on a shaft 28 of the reciprocating means for reciprocating the ledger 23 within the path of the rod 12.

Referring to FIG. 2, the knife 24 is formed of a rotatable drum 29 and two sets of cutting discs 30, 30′. Each set of discs is formed, for example of a pair of discs which are rotatably mounted on the shaft 31 which is driven in an orbital path by a suitable means as is known. For example, the shafts 31 are rotatably mounted on the rotatable drum 29 which, in turn, is driven off the transmission of the apparatus 10 in known fashion. As indicated, each disc 30, 30′ is mounted on the shaft 31 at a slight angle for purposes as described below. In addition, a spacer tube 32 is placed between the discs 30, 30′ of each pair in order to space the discs apart from centerline-to-centerline a distance A equal to the plug length to be cut. The discs 30, 30′ are rotatably held on the shaft 31 by a washer 32 and nut 33 in known manner.

Referring to FIG. 3, the cutting discs 30, 30′ are positioned to pass through a respective one of the recesses 25 of the ledger 23. To this end, the cutting discs 30, 30′ of each pair are spaced laterally from each other relative to the drum 29, for example for a distance A from center-to-center of 5 millimeters. In similar fashion, the recesses 25 of the ledger 23 are spaced apart from center-to-center the same distance.

The reciprocating motion of the ledger 23 and the rotatable motion of the drum 29 are synchronized such that each pair of cutting discs 30, 30′ pass through the recesses 25 as the pair of cutting discs reach the lowermost position of the drum 29 as illustrated in FIG. 2 and as the ledger 23 moves into a forwardmost position. The ledger 23 moves rearwardly after a pair of cutting discs has passed through the recesses 25 of the ledger 23. At the point at which the discs 30, 30′ pass through the recesses 25, the discs 30, 30′ are at a small angle to the path of the rod 12 and, as viewed from above, the discs 30, 30′ are inclined in the direction of rod travel. This is exaggerated for illustration in FIGS. 3 and 9.

Referring to FIG. 3, as the rod 12 passes through the guide tubes 27 of the ledger 23, the pairs of cutting discs 30, 30′ sequentially pass through the recesses 25. At such times, each pair of cutting discs 30, 30′ severs the rod in two places to produce two filter plugs 14, 15.

Referring to FIGS. 2 and 4, the knife assembly also employs various sharpening means 34, 35 in order to maintain the cutting discs in a sharpened condition. For this purpose, two of the sharpening means 34 are each composed of a pair of whetting wheels 36 mounted on a shaft 37 which, in turn, is mounted in any suitable fashion on the knife assembly 13 or the apparatus 10. The whetting wheels 36 may rotate on the shaft 37 so as to present fresh surfaces for sharpening of the cutting disc edges. As shown in FIG. 2, the pairs of whetting wheels 36 are mounted in reverse angular relationship relative to the pairs of cutting discs 30, 30′. In this fashion, one pair of whetting wheels 36 sharpen the right hand sides of the cutting discs 30, 30′, as viewed, while the other pair of whetting wheels 36 sharpen the left hand sides of the cutting discs 30, 30′. The relation between the whetting wheels 36 and cutting discs 30, 30′ is more particularly shown in FIG. 5.

The other sharpening means 35 is in the form of a cone-shaped ceramic-type block which is mounted on the ledger 23. In this regard, the block 35 is positioned in front of the intermediate wall 26 of the ledger 23 so as to have the cutting discs 30, 30′ pass about opposite sides immediately prior to cutting of the filter rod 12.

Referring to FIG. 1, the means 16 for spacing the plugs 14, 15 is of generally known construction and includes a spoked wheel 37 having a plurality of spokes 38 which project into the path of the plugs 14, 15. As shown, the plugs 14, 15 pass from the last guide tube 27 of the ledger 23 directly onto the paper 20 and a conveyor belt 39 of a conveyor 40 of known construction. In addition, the plugs 14, 15 are held on the conveyor belt 39 by a suitable holddown device 41 composed of a pair of pulley wheels 42 and two endless wires 43. The wires 43 serve to hold the plugs 14, 15 on the conveyor belt 39 while the spoked wheel 37 is placed between the endless wires 43 so as to effect a uniform spacing between the filter plugs 14, 15 on the conveyor belt 39. The speed of the spoked wheel 37 is timed with the speed of the conveyor 39 and the filter rod 12 so as to produce a uniform spacing between the plugs 14, 15.

Alternatively, the means for spacing the plugs 14, 15 at equal spacings may be of other suitable known structure.

Referring to FIG. 1, the means 17 for depositing the absorptive type filter material is of generally known construction. To this end, the means 17 is in the form of a rotatable wheel 46 having a plurality of peripherally spaced chambers 47 which receive and discharge the filter material 18. These chambers 47 are spaced about the wheel in equally spaced fashion. Each chamber 47 cooperates with a piston 48 in known fashion and with a plunger 49 which pushes the pistons 48 into the chamber 47 at a discharge station at the lower end of the wheel 46. For this purpose, the plunger 49 is actuated by a cam 50 of known construction.

The means 19 for wrapping the paper 20 about the plugs 14, 15 and filter material 18 is of any suitable known construction, such as the conventional garniture section. Similarly, the knife 22 for severing the filter rod 21 is of conventional structure. Consequently, these structures need not be further described.

Referring to FIG. 6, as the plugs 14, 15 pass out of the knife assembly 13 and are spaced apart on the conveyor 40, each is spaced from the other by an equal distance B of, for example 4 millimeters. As shown in FIG. 7, the adsorptive filter material 18 is deposited into the spaces between the filter plugs 14, 15 in conventional fashion.

Figure 8:
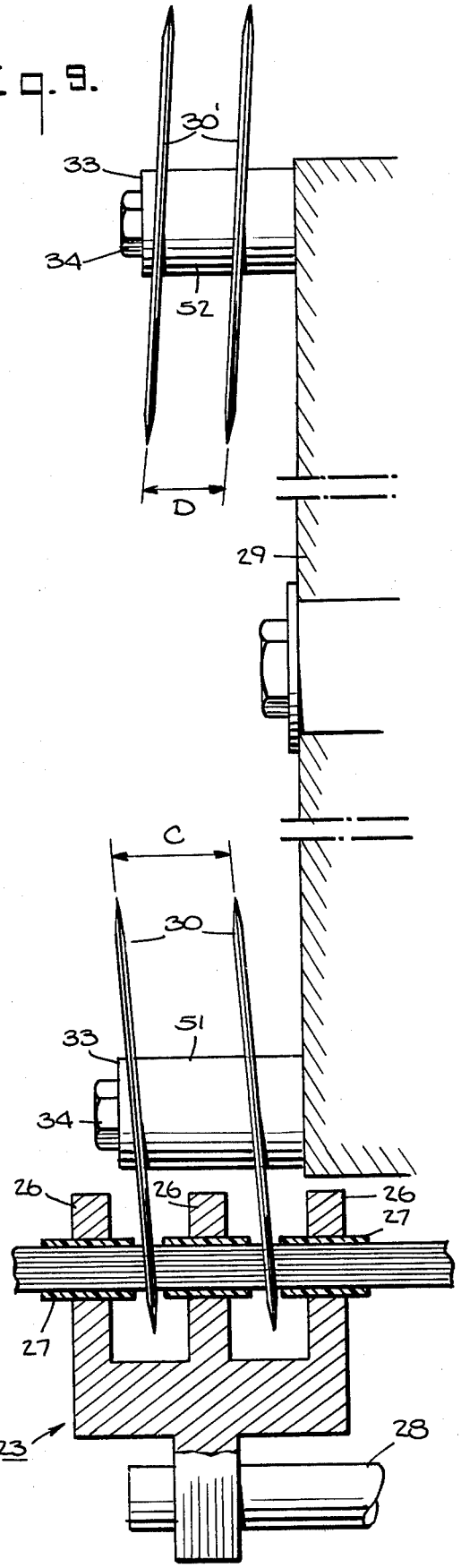
FIG. 8 illustrates a continuous filter rod formed on the apparatus of FIG. 1.

Referring to FIG. 8, the resulting filter rod 21 contains repeating sections of the plugs 14, 15 and filter material 18. Generally, the lengths which are cut from the filter rods 21 are sufficient to provide six filters. In the example given, for plug lengths of 9 millimeters and a charcoal containing chamber of 4 millimeters in length, the severed filter rod lengths are 78 millimeters. An individual filter severed from these rods 21 include two filter plug sections of a length of 4 ½ millimeters and an intermediate charcoal chamber 18 of 4 millimeters in length.

Figure 9:
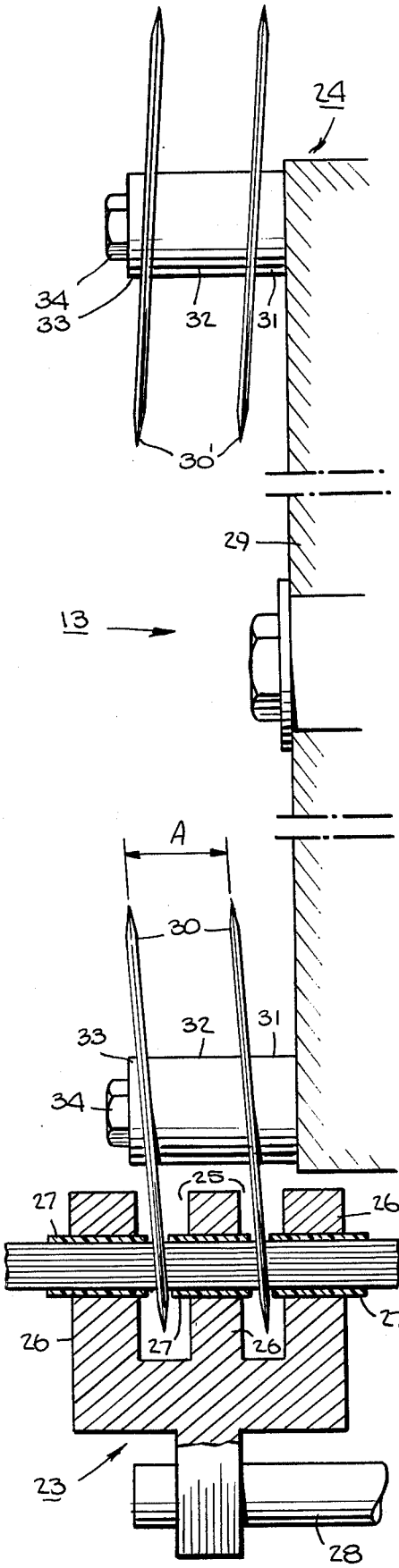
FIG. 9 illustrates a fragmented side view of a modified knife assembly in accordance with the invention.

Referring to FIG. 9, in order to cut filter plugs of different lengths, the cutting discs 30, 30' may be separated by a greater distance C or a lesser distance D by use of spacer tubes 51, 52 of different lengths. Corresponding changes in the relationship of the guide tubes and the size of the recesses in the ledger are also made to accommodate these spacings. In addition, the speed of the filter rod 21 is changed accordingly. For example, if the distance from centerline-to-centerline of the blades 30 is increased to 14 millimeters, the speed of the filter rod is increased to 4.2 meters per minute in order to produce 6,000 plugs per minute. Conversely, if the distance D is reduced to 5 millimeters, the speed of the filter rod is reduced to 3.0 meters per minute to produce 6,000 plugs per minute.

It is to be noted that the cutter may be provided with more than two cutting discs for each set of cutting discs. For example, the cutter may be provided with two sets of three discs each. In this case, for a drum speed of 1500 rpm, the speed of the filter rod would be 9,000 plugs per minute. For a plug length of 9 millimeters, the speed would be 8.1 meters per minute.

The invention thus provides a knife assembly which can be mounted on known machines in a relatively simple manner and which can be used to sever a filter rod into filter plugs at a high output rate, for example up to 6,000 plugs per minute.

What is claimed is:

1. In an apparatus for making filter rods, the combination comprising means for delivering a continuous rod of entrainment-type filter material in a predetermined path; and a knife assembly in said path for severing discrete plugs from said rod, said knife assembly including a ledger having a plurality of recesses therein and guide tubes extending across said recesses to guide the continuous rod of filter material therethrough, two sets of cutting disks, each said set of cutting disks being positioned to simultaneously pass through a respective one of said recesses of said ledger; and a sharpening means including pairs of whetting disks in the path of said cutting disks for sharpening opposite sides of each respective cutting disk and a cone-shaped block mounted on said ledger for sharpening a respective side of two of said cutting disks.

* * * * *